US008701326B2

(12) United States Patent
Zonshine

(10) Patent No.: US 8,701,326 B2
(45) Date of Patent: Apr. 22, 2014

(54) PISTOL BARREL SYSTEM AND METHOD

(75) Inventor: Amir Zonshine, Phoenix, AZ (US)

(73) Assignee: Sturm, Ruger & Company, Inc.

( * ) Notice: Subject to any disclaimer, the term of this patent is extended or adjusted under 35 U.S.C. 154(b) by 17 days.

(21) Appl. No.: 13/443,338

(22) Filed: Apr. 10, 2012

(65) Prior Publication Data

US 2013/0145669 A1 Jun. 13, 2013

Related U.S. Application Data

(60) Provisional application No. 61/568,449, filed on Dec. 8, 2011.

(51) Int. Cl.
*F41A 21/00* (2006.01)

(52) U.S. Cl.
USPC ..... 42/77; 89/14.05

(58) Field of Classification Search
USPC ..... 42/76.01, 76.1, 77, 78; 89/14.05, 14.7
See application file for complete search history.

(56) References Cited

U.S. PATENT DOCUMENTS

| | | | | | |
|---|---|---|---|---|---|
| 1,357,393 | A | * | 11/1920 | Fullerton | 42/10 |
| 2,151,676 | A | | 3/1939 | Appleby | |
| 2,976,638 | A | | 3/1961 | Owens | |
| 3,027,672 | A | | 4/1962 | Sullivan | |
| 3,442,172 | A | | 5/1969 | Wehrmann et al. | |
| 3,677,132 | A | * | 7/1972 | Plenge | 89/14.2 |
| 3,724,326 | A | | 4/1973 | Day | |
| 3,849,924 | A | | 11/1974 | Whitlinger | |
| 3,975,982 | A | | 8/1976 | Terstegge | |
| 4,127,056 | A | * | 11/1978 | Kart | 89/128 |
| 4,253,377 | A | * | 3/1981 | Arnett | 89/163 |
| 4,404,765 | A | | 9/1983 | Reudelsterz et al. | |
| 4,408,410 | A | * | 10/1983 | A'Costa | 42/90 |
| 4,412,397 | A | | 11/1983 | Bayn | |
| 4,455,777 | A | | 6/1984 | Callies | |
| 4,506,604 | A | | 3/1985 | Hughes | |
| 4,608,909 | A | * | 9/1986 | Peters | 89/196 |
| 4,674,217 | A | | 6/1987 | Matievich | |
| 4,707,942 | A | * | 11/1987 | Peters | 42/77 |
| 4,735,009 | A | | 4/1988 | Jett, Jr. | |
| 4,833,810 | A | | 5/1989 | Domian | |
| 4,920,676 | A | * | 5/1990 | Peters | 42/25 |
| 4,939,977 | A | | 7/1990 | Stroup | |

(Continued)

FOREIGN PATENT DOCUMENTS

| | | | |
|---|---|---|---|
| DE | 3204823 | A | 8/1983 |
| DE | 3308665 | A1 | 9/1984 |

(Continued)

OTHER PUBLICATIONS

International Search Report and Written Opinion dated Aug. 6, 2013 (PCT/US2012/068573).

*Primary Examiner* — Benjamin P Lee
(74) *Attorney, Agent, or Firm* — The Belles Group, P.C.

(57) ABSTRACT

An interchangeable barrel system and related method for a pistol includes a barrel insert having an anti-rotation protrusion and a receiver having a complementary configured socket configured for receiving the protrusion. An embodiment of a barrel insert includes a chamber for holding a cartridge and a locking mechanism configured for releasably securing the barrel insert to the receiver. In some embodiments, the locking mechanism comprises a threaded engagement between the barrel insert and receiver. The system allows barrel inserts of different calibers, configurations, and materials to be swapped with the receiver, and vice-versa.

15 Claims, 11 Drawing Sheets

(56) References Cited

U.S. PATENT DOCUMENTS

| | | | | |
|---|---|---|---|---|
| 4,955,157 | A * | 9/1990 | Brighton et al. | 42/77 |
| 5,005,463 | A | 4/1991 | A'Costa | |
| 5,029,512 | A | 7/1991 | Latka | |
| 5,133,142 | A * | 7/1992 | Peters | 42/25 |
| 5,325,617 | A * | 7/1994 | Vojta et al. | 42/75.03 |
| 5,341,719 | A | 8/1994 | Bullis et al. | |
| 5,563,362 | A * | 10/1996 | York | 89/14.3 |
| 5,692,334 | A | 12/1997 | Christensen | |
| 5,768,815 | A | 6/1998 | Casull | |
| 5,860,242 | A | 1/1999 | O'Neil | |
| 5,900,577 | A * | 5/1999 | Robinson et al. | 89/191.01 |
| 5,969,285 | A | 10/1999 | Krebs | |
| 6,494,195 | B2 | 12/2002 | Perry et al. | |
| 6,574,898 | B2 | 6/2003 | Spencer et al. | |
| 6,594,936 | B1 | 7/2003 | Sniezak et al. | |
| 6,606,812 | B1 | 8/2003 | Gwinn, Jr. | |
| 6,634,128 | B1 | 10/2003 | Vastag | |
| 6,655,372 | B1 | 12/2003 | Field et al. | |
| 6,701,656 | B2 | 3/2004 | Schlenkert et al. | |
| 6,769,209 | B2 | 8/2004 | Mendoza-Orozco | |
| 6,789,342 | B2 * | 9/2004 | Wonisch et al. | 42/75.02 |
| 6,889,464 | B2 | 5/2005 | Degerness | |
| 6,959,509 | B2 | 11/2005 | Vais | |
| 7,000,345 | B1 * | 2/2006 | Kay | 42/75.02 |
| 7,076,904 | B1 | 7/2006 | Rustick | |
| 7,121,035 | B2 | 10/2006 | Greer | |
| 7,152,357 | B2 | 12/2006 | Huston | |
| 7,275,342 | B2 | 10/2007 | Medvedeo | |
| 7,392,803 | B2 | 7/2008 | Liao | |
| 7,444,775 | B1 | 11/2008 | Schuetz | |
| 7,451,564 | B2 * | 11/2008 | Wait | 42/75.02 |
| 7,610,710 | B2 * | 11/2009 | Brittingham | 89/14.4 |
| 7,628,149 | B1 | 12/2009 | Zarecky et al. | |
| 7,748,306 | B1 | 7/2010 | Curry et al. | |
| 7,775,200 | B2 | 8/2010 | Anderson | |
| 7,866,079 | B2 | 1/2011 | Keeney et al. | |
| 7,921,590 | B2 | 4/2011 | Briggs | |
| 7,934,332 | B2 | 5/2011 | Briggs | |
| 7,975,417 | B2 | 7/2011 | Duplessis et al. | |
| 8,079,169 | B2 * | 12/2011 | Gregg | 42/75.03 |
| 8,365,453 | B2 * | 2/2013 | Goddard | 42/7 |
| 8,365,647 | B2 * | 2/2013 | Lippard | 89/14.8 |
| 8,397,415 | B2 * | 3/2013 | Laney et al. | 42/75.02 |
| 8,397,416 | B2 * | 3/2013 | Laney et al. | 42/75.02 |
| 2002/0116857 | A1 | 8/2002 | Wonisch | |
| 2004/0244258 | A1 | 12/2004 | O'Dwyer et al. | |
| 2007/0256345 | A1 | 11/2007 | Hall et al. | |
| 2008/0168695 | A1 * | 7/2008 | Nakayama | 42/75.02 |
| 2008/0202009 | A1 | 8/2008 | Saxby | |
| 2011/0289813 | A1 * | 12/2011 | Serandour | 42/76.01 |
| 2012/0073177 | A1 * | 3/2012 | Laney et al. | 42/16 |
| 2013/0118049 | A1 * | 5/2013 | Lippard | 42/76.1 |

FOREIGN PATENT DOCUMENTS

| | | | |
|---|---|---|---|
| DE | 3740371 | A1 | 11/1987 |
| GB | 836697 | | 6/1960 |
| WO | 9216815 | A1 | 10/1992 |
| WO | 2006120421 | A1 | 11/2006 |
| WO | 2010111026 | | 9/2010 |

* cited by examiner

PISTOL BARREL SYSTEM AND METHOD

CROSS-REFERENCE TO RELATED APPLICATIONS

The present application claims priority to commonly owned U.S. Provisional Application No. 61/568,449 filed Dec. 8, 2011, the entire contents of which are incorporated herein by reference in its entirety.

BACKGROUND OF THE DISCLOSURE

The present disclosure generally relates to firearms, and more particularly to an interchangeable barrel system and method for pistols.

Semi-automatic pistols generally include a frame having a grip portion for grasping by the user, barrel defining a chamber for holding a cartridge, trigger-actuated firing mechanism for cocking and releasing a striker or hammer to detonate the cartridge, and an axially reciprocating bolt. The bolt defines a breach block for forming an openable and closeable breech with the rear of the chamber as well known to those skilled in the art.

Barrels, which functionally are pressure vessels, are typically made of a durable and strong material such as steel to withstand the combustion forces and temperatures associated with firing the pistol. However, steel is heavier than some metals such as aluminum often used for other firearm components thereby adding to the total weight of the pistol. In addition, the use of exposed steel barrels may limit the ability to customize the aesthetic appearance of the pistol. Metals such as aluminum are generally more malleable and amenable to machining and applying various aesthetic enhancements such as colorization, fluting, etc., for greater customization.

An improved barrel system for pistol is therefore desired.

SUMMARY OF THE DISCLOSURE

A barrel system for a firearm such as a pistol according to embodiments of the present disclosure provides a lightweight barrel-receiver assembly. In some embodiments, for example without limitation, an outer aluminum receiver is combined with an inner durable steel barrel insert which is removably mounted thereto. In some embodiments, the barrel insert may be structurally self-supporting independent of the receiver to withstand combustion forces as opposed to merely a thin steel liner or cladding applied to an outer barrel sleeve or receiver constructed of a relatively softer, less durable metal such as aluminum incapable of withstanding combustion forces from discharging the pistol. This advantageously allows the barrel insert to be readily replaced and/or interchanged with other types of inserts while retaining the original receiver. In addition, this interchangeable barrel system allows a user to switch receivers of different types, lengths, and configurations while merely transferring the barrel insert to various receivers. Conversely, the user may retain the same receiver and switch out barrel inserts to different types, lengths, configurations, and chambering to allow different caliber ammunition to be fired from the same pistol-receiver combination by merely swapping barrel inserts. For example, in one embodiment the receiver may be configured and dimensioned for retaining barrel inserts capable of firing either 0.22 or 0.45 caliber cartridges by swapping or switching differently configured and constructed barrel inserts thereby providing a versatile pistol platform suitable for firing multiple size cartridges.

Embodiments of the barrel system include an anti-rotation device for preventing rotation of the barrel insert with respect to the receiver and a locking member for releasably mounting and securing the barrel insert at least partially inside the receiver. In one embodiment, the anti-rotation device is comprised of an anti-rotation protrusion formed on the barrel insert and a complementary configured and mating recess or socket formed in the receiver for receiving the protrusion.

In one embodiment, the locking member may be a barrel nut or cap configured to threadably engage the barrel insert to releasably secure the barrel insert to the receiver. Advantageously, the barrel insert is not permanently affixed to the receiver with the use of pins or threaded screws that may become lost especially in the field.

According to one embodiment, an interchangeable barrel system for a pistol includes an elongated barrel insert including a rear portion defining a chamber configured for holding a cartridge, and a forward muzzle portion having a bore defining a longitudinal axis and bullet pathway, and an elongated receiver fixedly mounted to a grip frame. The receiver remains stationary during firing of the pistol, and defines an internal cavity configured for axial insertion of the forward muzzle portion of the barrel insert into the receiver. In one embodiment, the muzzle portion is insertable through a rear open end of the receiver into the cavity. The barrel insert is nested inside the receiver, and in some embodiments is fully contained within the receiver except for a short stub section of the insert which may protrude beyond the front end of the receiver as further described herein. The barrel system further includes an anti-rotation device configured for preventing rotation of the barrel insert with respect to the receiver, and a locking member configured for releasably mounting the barrel insert to the receiver. In one embodiment, the anti-rotation device comprises an anti-rotation protrusion formed on the barrel insert and a complementary configured socket formed in the cavity of the receiver; the protrusion being axially insertable into the socket. The anti-rotation protrusion and mating socket may be polygonal or rectilinear shaped in some embodiments.

According to another embodiment, an interchangeable barrel system for a pistol includes an elongated barrel insert including a rear chamber block defining a chamber configured for holding a cartridge, a front muzzle end, and a forward muzzle portion extending between the muzzle end and the chamber block; the muzzle portion having a bore defining a longitudinal axis and a bullet pathway. An elongated receiver fixedly mounted to a grip frame is provided. The receiver remains stationary during firing of the pistol, and defines an internal cavity aligned with the longitudinal axis and extending from a rear end to a forward end of the receiver. The muzzle portion of the barrel insert is insertable into and substantially disposed in the cavity. In one embodiment, the muzzle portion and front muzzle end of the barrel insert are insertable through an open rear end of the receiver into the cavity. The barrel system further includes an anti-rotation device configured for preventing rotation of the barrel insert with respect to the receiver, and a locking member threadably engaging the barrel insert and securing the barrel insert in the receiver. In one embodiment, the anti-rotation device comprises a rectilinear or polygonal shaped protrusion formed on the barrel insert and a complementary configured socket formed in the cavity of the receiver, the protrusion being axially insertable into the socket. When the protrusion is seated in the socket, rotation of the barrel insert is prevented by lateral mutual engagement between peripheral surfaces formed on the anti-rotation protrusion and in the socket. In one embodiment, the protrusion and socket have a square configuration.

A method for assembling a barrel system for a pistol is provided. In one embodiment, the method includes: providing an elongated barrel insert including a rear portion defining a chamber configured for holding a cartridge, a front muzzle end, and a forward muzzle portion having a bore defining a longitudinal axis and bullet pathway; axially inserting the barrel insert into a receiver; axially engaging an anti-rotation protrusion on the barrel insert with a complementary configured socket in the receiver, the protrusion preventing relative rotation between the barrel insert and the receiver; and locking the barrel insert into the receiver. In one embodiment, the inserting step is performed by axially inserting the front muzzle end of the barrel insert through a rear opening of the receiver into an internal cavity disposed inside the receiver. In various embodiments, the locking step includes threadably engaging a barrel cap with the forward muzzle portion of the barrel insert through an open front end of the receiver, and axially drawing the barrel insert forward by rotating the barrel cap. Rotating the barrel cap tightens engagement between a forward facing surface of the barrel insert and rear facing surface of the receiver to secure the barrel insert in the receiver.

BRIEF DESCRIPTION OF THE DRAWINGS

The features of the exemplary embodiments will be described with reference to the following drawings where like elements are labeled similarly, and in which.

All drawings are schematic and not necessarily to scale.

Figure 6A:
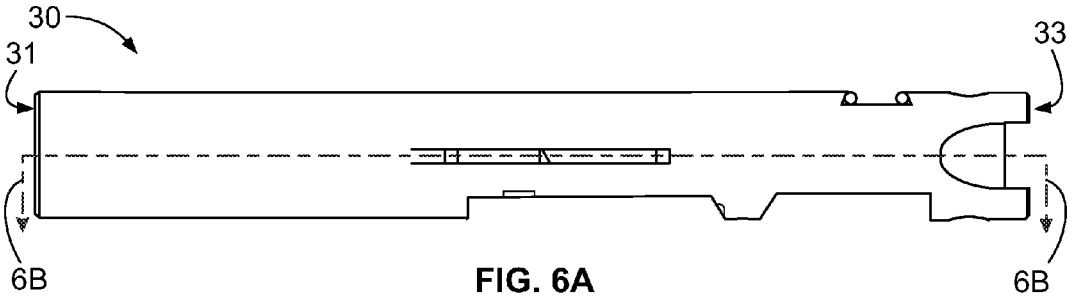
FIG. 6A is a side view of the receiver of FIG. 1.

It should be noted that any references herein to a single figure number (e.g. FIG. 6) which includes a family of multiple sub-figures designated by an alphabetic suffix (e.g. FIGS. 6A, 6B, 6C, etc.) shall be construed to be a reference to all of the sub-figures included in that family unless specifically noted otherwise.

DESCRIPTION OF EXEMPLARY EMBODIMENTS

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

Figure 1:
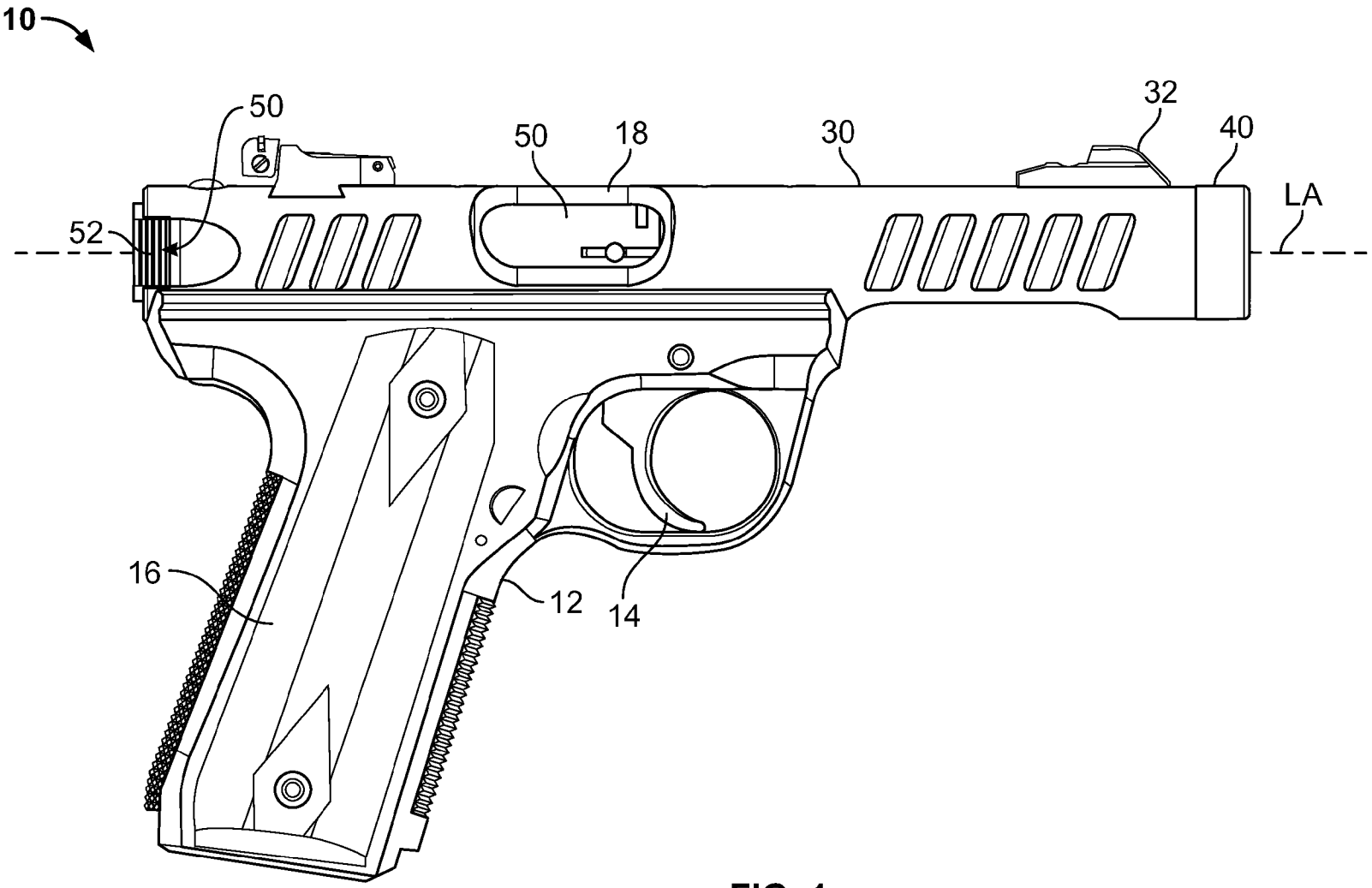
FIG. 1 is a side view of one embodiment of a pistol with barrel system according to the present disclosure.

FIG. 1 depicts one embodiment of a semi-automatic pistol 10 having an interchangeable barrel system according to the present disclosure. FIGS. 2-5 are assembly drawings for the barrel system.

Referring to FIGS. 1-5, pistol 10 defines a longitudinal axis LA and includes a grip frame 12 having a trigger guard portion and a barrel-receiver assembly including a barrel insert 20 and receiver 30. The rear of the frame 12 defines an elongated grip 16 for holding pistol 10. Frame 12 may be made of any suitable material commonly used in the art including metal, polymer, or combinations thereof.

Pistol 10 includes a conventional firing mechanism including a trigger 14 which is operable to cock and release a hammer (not shown). In some embodiments, a spring-biased reciprocating bolt 50 is provided having opposing laterally projecting bolt ears 52 at the rear for manually retracting the bolt. Bolt 50 is generally cylindrical in shape and slidably mounted inside receiver 30 (forward portion of bolt 50 also visible through ejection portion 18 in FIG. 1) for rearward and forward recoil movement upon discharging the pistol. In some embodiments, bolt 50 is made of steel or an alloy thereof. Bolt 50 includes a conventional firing pin assembly 54 for striking a chambered cartridge and a cartridge extractor assembly 56 as will be well known in the art (see FIG. 9). In operation, pulling the trigger 14 releases the hammer which strikes and drives the firing pin forward to detonate the cartridge. This in turn drives the bolt 50 rearward under the recoil forces to extract and eject the cartridge casing through ejector port 18. The bolt 50 is returned forward under the biasing force of a recoil spring 58. The foregoing type of bolt firing mechanism may be found, for example, in the Ruger Mark III pistol available from Sturm, Ruger & Company, Inc. of Southport, Conn. However, it will be noted that embodiments of a barrel system according to the present disclosure are expressly not limited in use to this particular pistol, but broadly adaptable to any type of firearm including pistols and rifles.

FIGS. 2-5 show various views of the barrel-receiver assembly 20-30 and related components. FIGS. 6A-E shows various views of the receiver 30 alone. Receiver 30 is an axially elongated and generally hollow cylindrical or tubular structure having a body defining a longitudinally-extending internal cavity 38. Receiver 30 further includes an open front end 31, opposing open rear end 33, and an ejection port 18 (see FIG. 1). Cavity 38 may be generally circular in cross section and may vary in diameter along the length of the receiver. In some embodiments, the forward portion 38*b* of cavity 38 which receives barrel insert 20 may have a reduced diameter being smaller than a rear portion 38*a* of the cavity which slidably receives the bolt 50 therein. In one embodiment, forward portion 38*b* of cavity 38 has a substantially tubular shape with a generally circular transverse cross section and defines a forward muzzle section of receiver 30 between front end 31 and socket 34 which provides an outer sleeve generally surrounding and enclosing tubular muzzle portion 27 of barrel insert 20. Cavity 38 may extend axially completely through receiver 30 and communicate with open front (muzzle) and rear ends 31, 33 as shown.

Receiver 30 may be mounted in a rigid and stationary manner to grip frame 12 via any suitable mechanical attachment means commonly used in the art including without limitation fasteners. The receiver 30 remains stationary when pistol 10 is fired in one embodiment and does not reciprocate with respect to the grip frame 12. When mounted on pistol 10, the receiver 30 extends axially forward beyond the grip frame 12 and has a forward portion of substantial length that is cantilevered from and not directly supported by the frame in one embodiment as shown in FIG. 1. A front sight 32 may be mounted on receiver 30 on this unsupported forward portion as shown.

FIGS. 7A-D depicts various views of barrel insert 20 which includes an open front muzzle end 23 and an open rear end 25. Barrel insert 20 is axially elongated and defines a longitudinally-extending bore 22 extending therethrough that communicates with open front and rear ends 23, 25. Barrel insert 20 includes a diametrically enlarged rear boss or portion 21 disposed proximate to rear end 25 and a tubular muzzle portion 27 of relatively constant inside diameter that projects axially forward from the rear portion to front or muzzle end 23. Bore 22 in tubular muzzle portion 27 defines a pathway for a bullet and may be rifled in a conventional manner as shown. Rear portion 21 of barrel insert 20 defines a chamber block which may be generally cylindrical in shape in some embodiments to mate with a complementary configured portion of cavity 38 in receiver 30. A chamber 28 is defined or formed in enlarged rear portion 21 configured for holding a cartridge and has a greater wall thickness than tubular muzzle portion 27 to provide additional reinforcement and support for the cartridge casing when firing the pistol 10. A downward sloping cartridge feed ramp 24 is disposed at the bottom of rear end 25 protruding from enlarged rear portion 21 to upload cartridges into chamber 28 from a magazine removably inserted in grip 16 in a conventional manner as is well known in the art (see also FIGS. 1 and 2). Receiver 30 includes a bottom cartridge feed opening 38*c* that communicates with the magazine inside grip frame 12 for receiving cartridges which are loaded into chamber 28 by bolt 50 during cycling of the action.

In one embodiment, barrel insert 20 includes an anti-rotational device that is configured to engage receiver 30 in such a manner that the barrel insert is prevented from rotating with respect to the receiver. This maintains the proper positioning and orientation of the barrel insert and appurtenances such as the cartridge feed ramp 24 with respect to the receiver, bolt 50, and various other components of the action and firing mechanism. Rifling in bore 22 of barrel insert 20 will induce twisting or torsional forces on the barrel insert when pistol 10 is fired which are counter-acted by the anti-rotational device.

Figure 3:
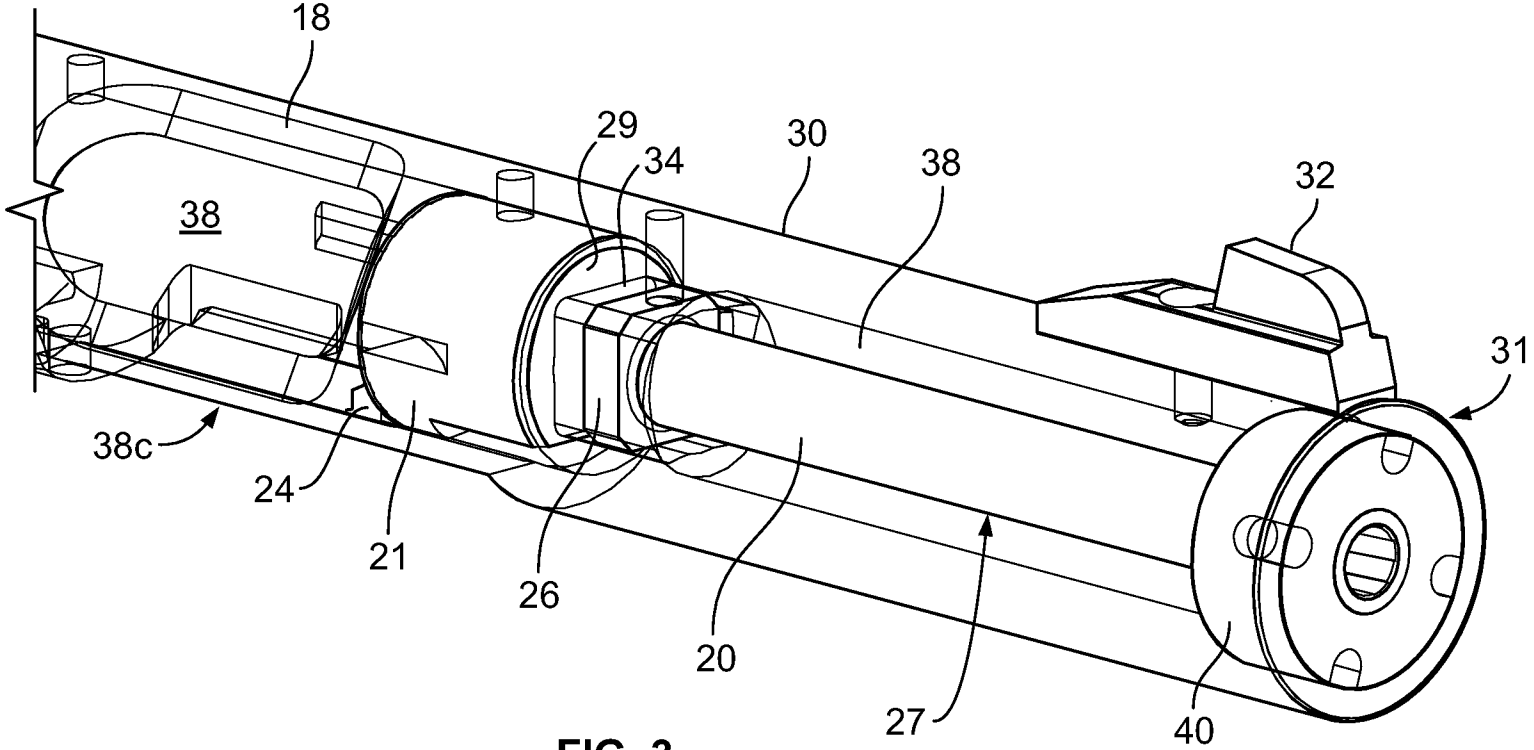
FIG. 3 is a perspective view of the barrel system of FIG. 1 showing the barrel insert positioned within the receiver.
Figure 4:
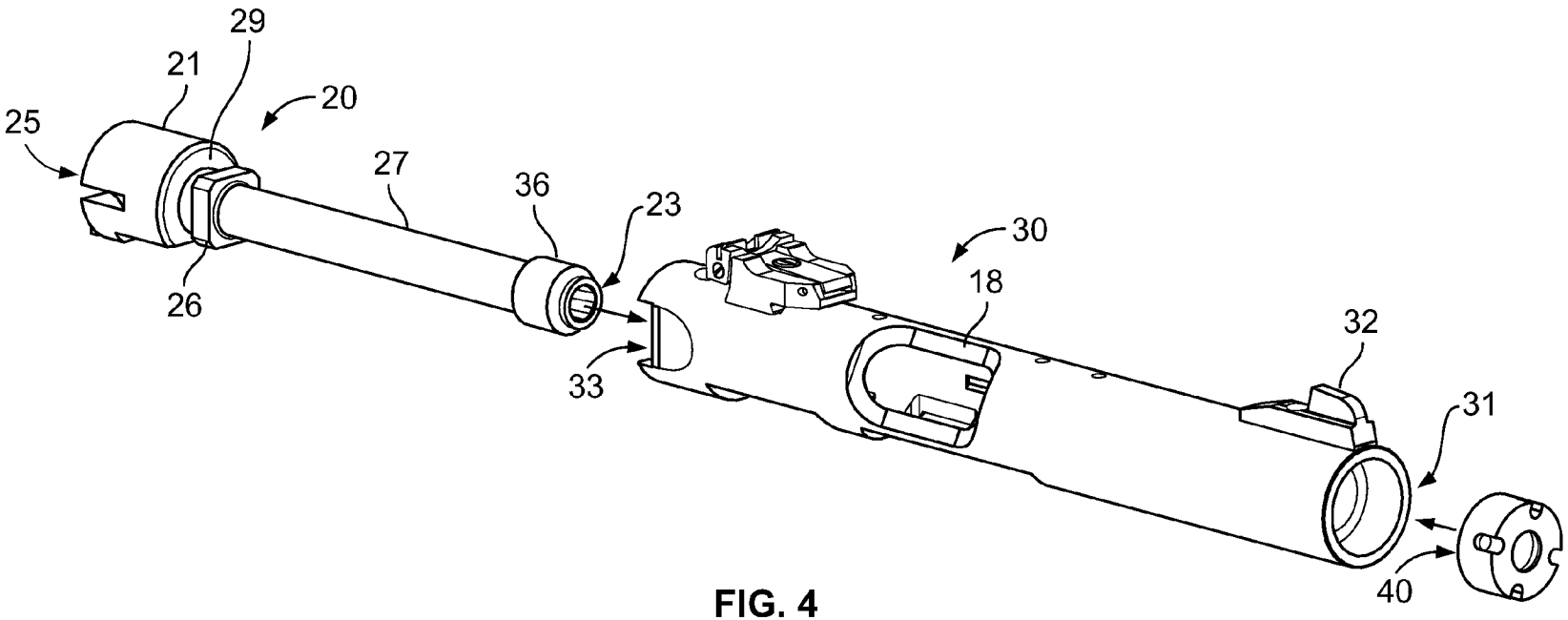
FIG. 4 is an exploded perspective view thereof.
Figure 5:
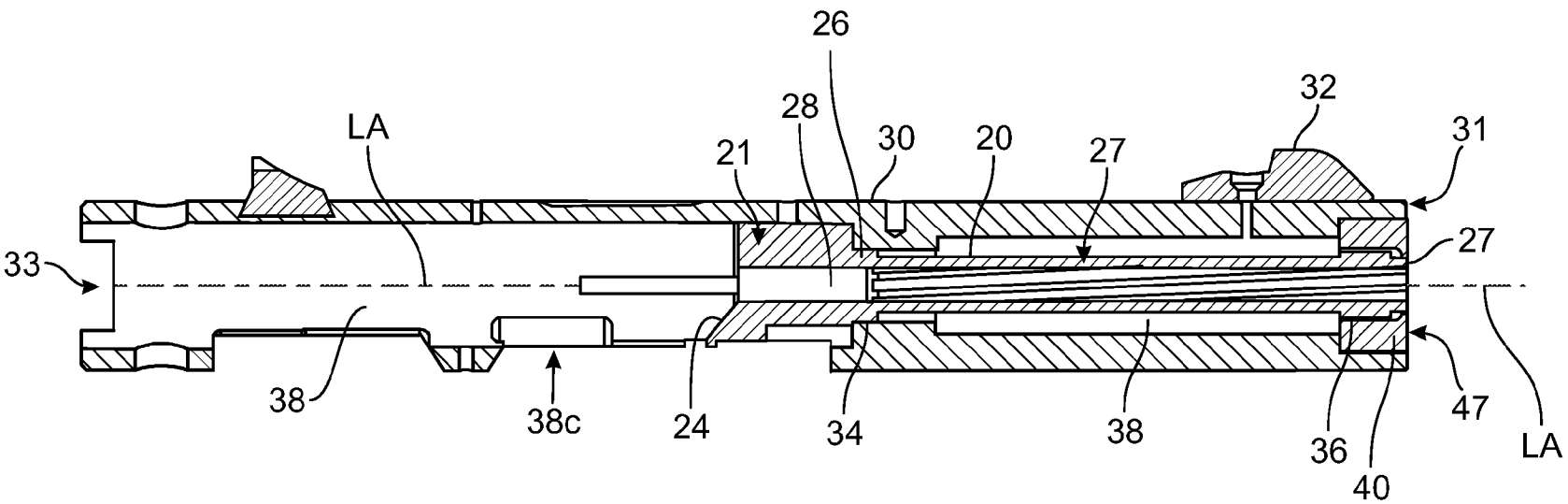
FIG. 5 is a cross-sectional side view thereof.

Referring to FIGS. 1-7, barrel insert 20 further includes at least one anti-rotation protrusion such as a polygonal or rectilinear shaped anti-rotation protrusion 26 in one embodiment that is dimensioned to be received in a complementary configured recess or socket 34 formed in receiver 30. In one embodiment, protrusion 26 may be square in configuration. Other suitable rectilinear shapes may be used (e.g. hexagonal, triangular, etc.) so long as barrel insert 20 will not rotate when protrusion 26 is seated in socket 34 of the receiver. In one embodiment (see, e.g. FIGS. 2, 5, and 7A-D), protrusion 26 abuts and projects axially forward from enlarged rear portion 21 of barrel insert 20 and extends radially or laterally outwards from tubular muzzle portion 27 transverse to longitudinal axis LA. As shown, in this embodiment, protrusion 26 is disposed between tubular muzzle portion 27 and enlarged rear portion 21 of barrel insert 20. In other possible embodiments contemplated, as shown in FIGS. 3,4, 11, and 12, protrusion 26 may be spaced axially apart from rear portion 21 along tubular muzzle portion 27. Accordingly, at least both foregoing embodiments and arrangements of protrusion 26 on barrel insert 20 are possible. Protrusion 26 may have a lateral width and vertical height (measured transverse to longitudinal axis LA) that is less than the outside diameter of enlarged rear portion 21 adjacent to the protrusion 26 (see FIGS. 7A-C). In one embodiment, as shown in FIGS. 5 and 7A-B, anti-rotation protrusion 26 is concentrically aligned with longitudinal axis LA. In other embodiments, anti-rotation protrusion 26 may be disposed off-axis. The anti-rotation protrusion may extend angularly around the entire outer circumference of tubular muzzle portion 27 of the barrel insert 28 as shown, or in other contemplated embodiments extend only around part of the circumference of the muzzle portion 27.

It will be appreciated that other types of complementary-configured protrusion-socket anti-rotation systems (e.g. tabs/slots, pins/holes, splines/grooves, etc.) may alternatively be used so long as barrel insert 20 will not rotate when mounted and secured in receiver 30. Accordingly, embodiments of an anti-rotation system that may be used are expressly not limited to the number, configuration, and placement of anti-rotation protrusions and mating sockets/recesses which are shown and described herein.

Figure 6B:
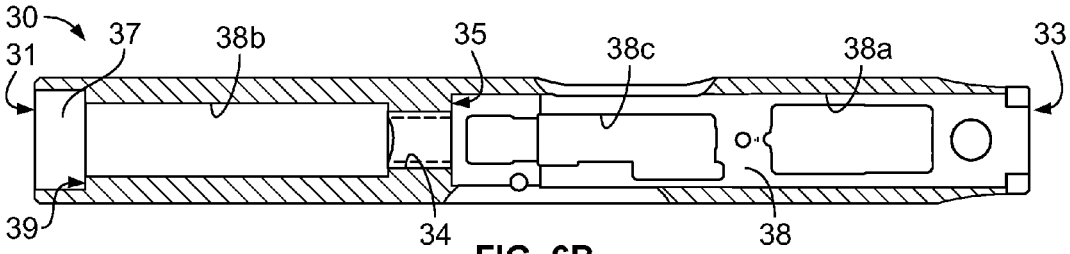
FIG. 6B is a cross-sectional top view thereof taken along line 6B-6B in FIG. 6A.
Figure 6C:
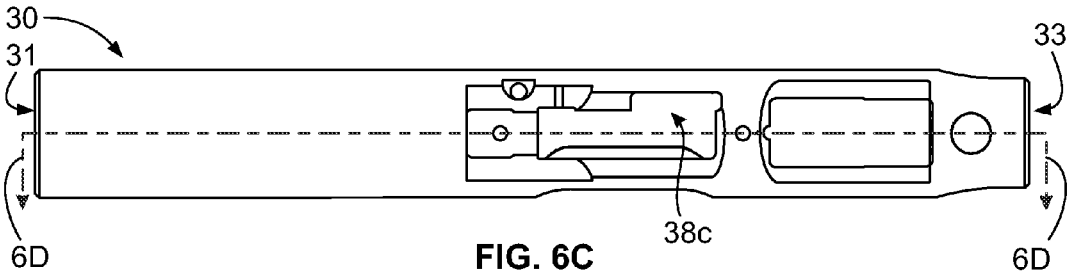
FIG. 6C is a bottom view of the receiver.
Figure 6D:
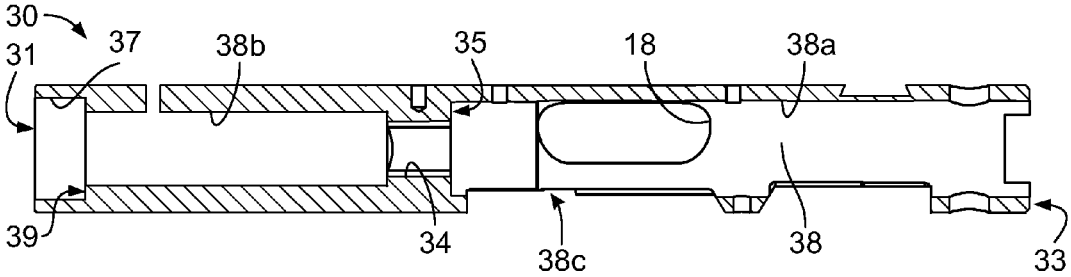
FIG. 6D is a cross-sectional side view thereof taken along line 6D-6D in FIG. 6C.
Figure 6E:
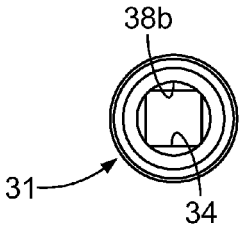
FIG. 6E is a front or muzzle end view of the receiver.
Figure 7A:
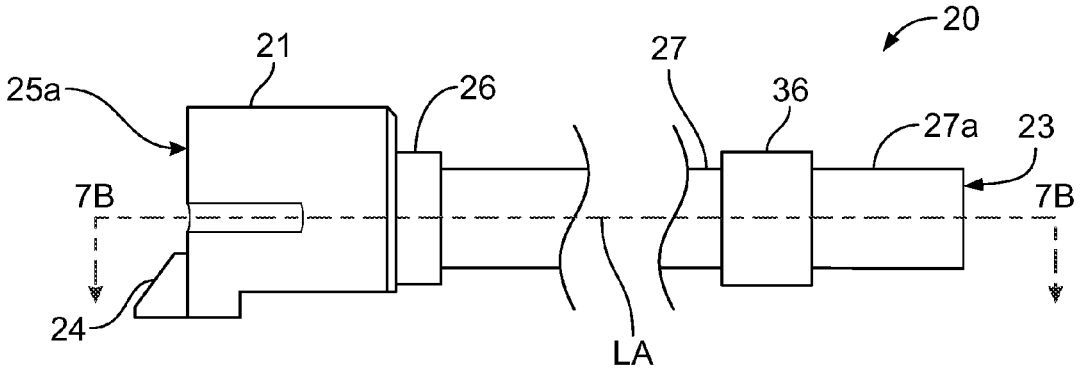
FIG. 7A is a side view of the barrel insert of FIG. 1.
Figure 7B:
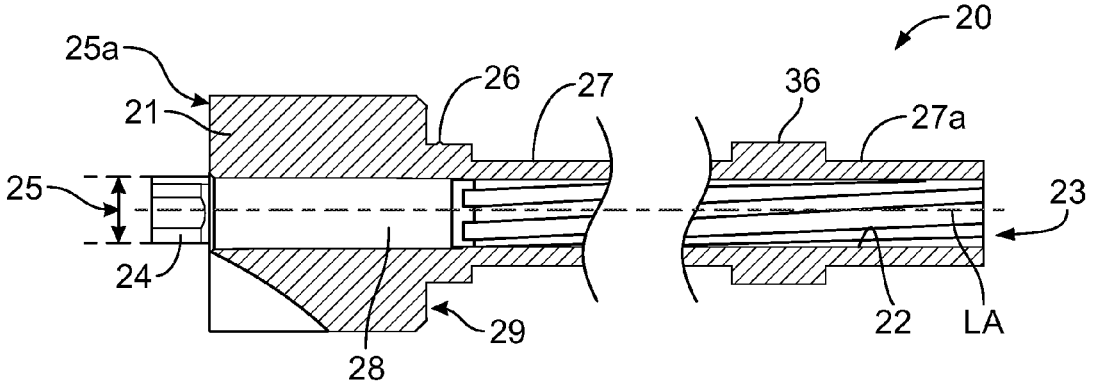
FIG. 7B is a cross-sectional top view thereof taken along line 7B-7B in FIG. 7A.
Figure 7C:
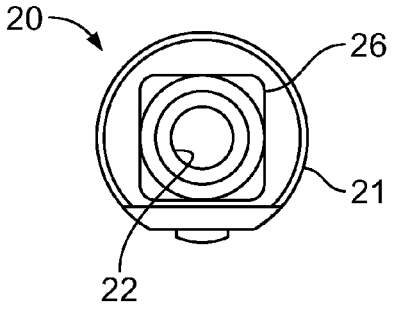
FIG. 7C is a right or front/muzzle end elevation view of the barrel insert.
Figure 7D:
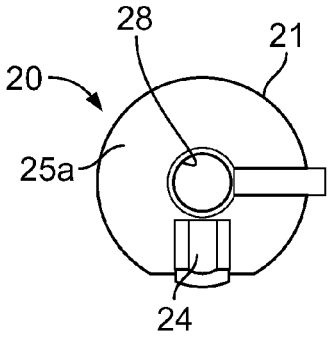
FIG. 7D is a left or rear/breech end elevation view of the barrel insert.

In one embodiment, socket 34 is disposed between and separates forward portion 38*b* of receiver cavity 38 from rear portion 38*a*, as best shown in FIGS. 6B and 6D. Socket 34 communicates with forward and rear portions 38*b*, 38*a* of cavity 38 and is axially open completely through in this embodiment to allow insertion of tubular muzzle portion 27 of barrel insert 20 through the socket (see FIGS. 2-4). Accordingly, in some embodiments, the opening defined by socket 34 has a minimum transverse dimension to longitudinal axis LA that is dimensioned sufficiently large enough to permit insertion of the front muzzle end 23 and tubular muzzle portion 27 of barrel insert completely therethrough from the rear of the socket for assembling the barrel-receiver assembly 20-30 as further described herein.

Figure 2:
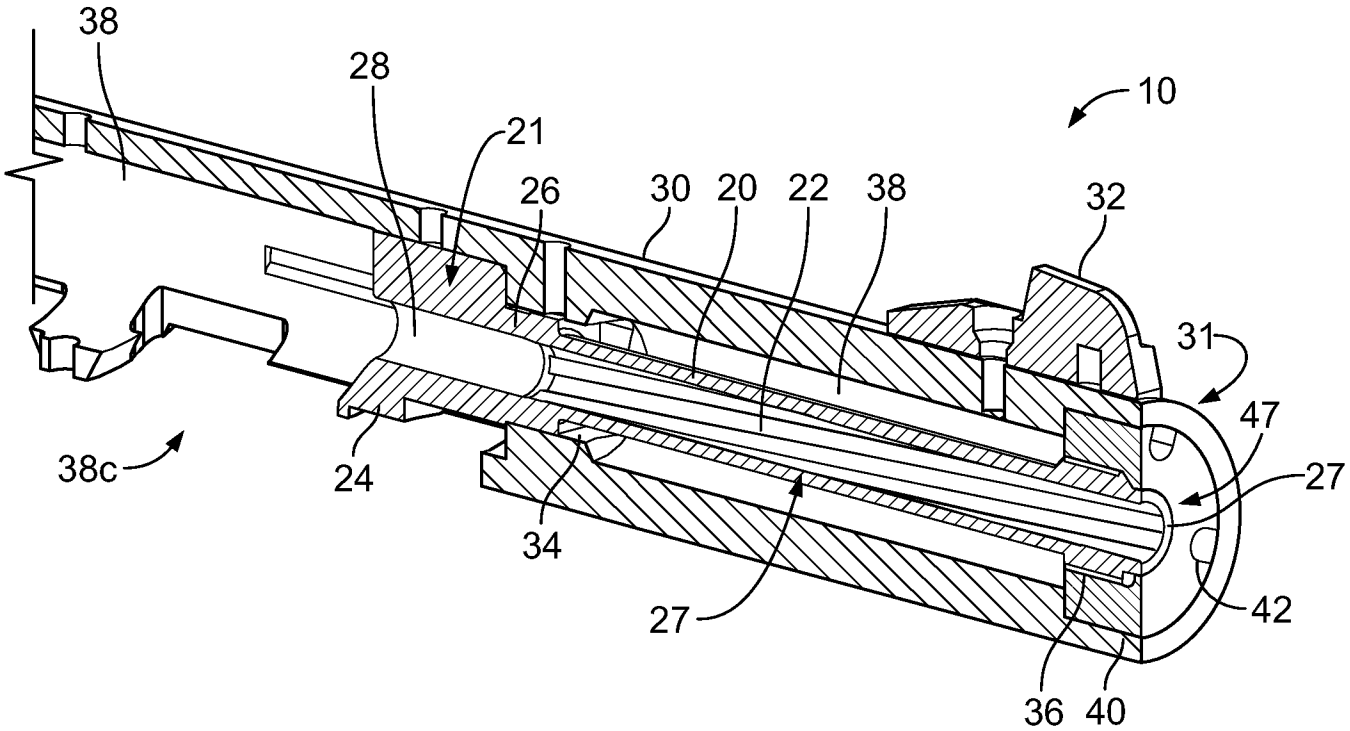
FIG. 2 is a cross-sectional perspective view of the barrel system of FIG. 1.

Barrel insert 20 is insertable through open rear end 33 of receiver 30. In some embodiments, referring to FIGS. 6A-E, a step is formed at the transition between the enlarged rear portion 21 and protrusion 26 to limit the insertion depth of protrusion 26 into socket 34, as shown in FIGS. 2-3 and 5. A forward facing vertical surface 29 defined at the transition step by enlarged rear portion 21 abuts a mating rear facing vertical surface 35 when barrel insert 20 is fully inserted into receiver 30.

Referring to FIGS. 1-7, barrel insert 20 further includes a forward externally-threaded locking ring 36 for mating to a complementary internally-threaded locking member such as barrel nut or cap 40 which acts as a barrel nut and secures the barrel insert in the receiver 30. Locking ring 36 may be located proximate to, but not necessary immediately adjacent to front end 23 of barrel insert 20. In one embodiment, locking ring 36 is spaced axially rearward by an axial distance from front end 23 to provide a short stub section 27*a* of barrel insert tubular muzzle portion 27 projecting forward from the threaded locking ring (see, e.g. FIGS. 4, 5, and 7A-B). This rearward spacing protects the threads on barrel insert 20 when mounted in receiver 30, and provides a closed, neat, and flush appearance between the barrel cap 40 and front muzzle end 23 of the barrel insert as shown in FIGS. 2 and 3.

In some embodiments, as shown, the threaded locking ring 36 may be formed on a diametrically enlarged and raised annular surface that projects radially outward from tubular muzzle portion 27. In other embodiments, locking ring 36 may be formed by threading an un-raised portion or surface of tubular muzzle portion 27 of the barrel insert. Accordingly, embodiments according to the present disclosure are expressly not limited to a diametrically enlarged locking ring 36 configuration.

Figure 8A:
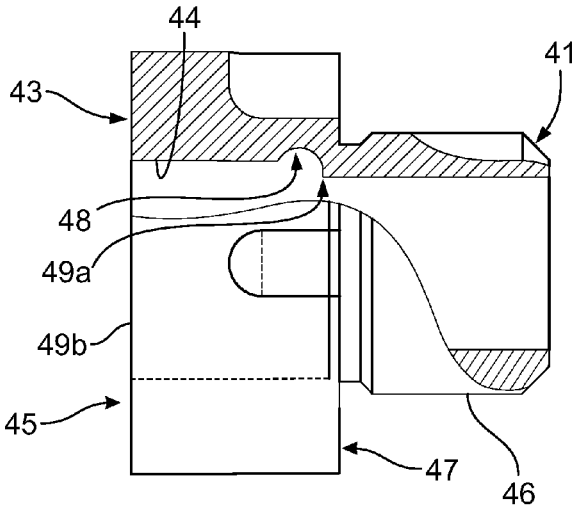
FIG. 8A is a side partial cross-sectional view of the barrel nut or cap of FIG. 1.
Figure 8B:
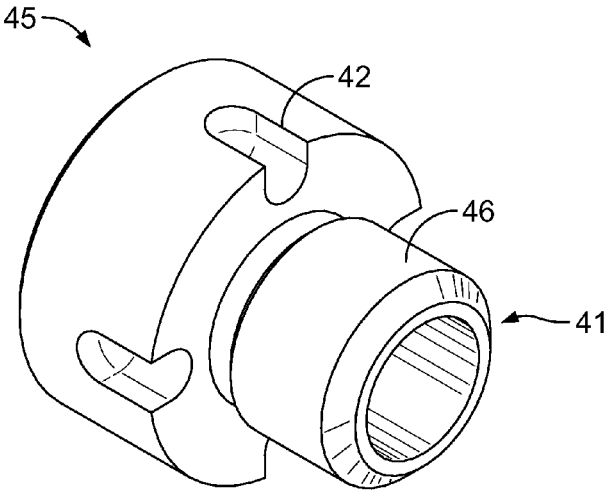
FIG. 8B is a perspective view thereof.
Figure 8C:
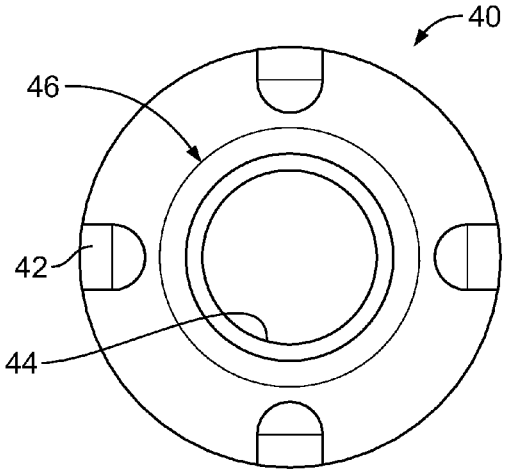
FIG. 8C is a right or front end elevation view thereof.

With additional reference to FIGS. 8A-C, barrel cap 40 is configured and dimensioned for insertion into the front end 31 of receiver 30 (see also FIGS. 2-5). Barrel cap 40 is generally cylindrical in shape and defines an axial passageway 44 having internal threads for mating with the external threads of mounting ring 36 on barrel insert 20. Accordingly, barrel cap 40 is configured and dimensioned for receiving mounting ring 36 and a front portion of tubular section 27 of barrel insert 20 in passageway 44. In one embodiment, a rear portion of passageway 44 contains threads extending axially from rear facing surface 43 at rear end 45 forward to front end 41 terminating at point proximate to but slightly rearward of front facing surface 47 (best shown in FIG. 8A). A diametrically enlarged annular groove 48 (in comparison to the diameter of passageway 44) is provided adjacent to front end 41 of barrel cap 40 proximate to front facing surface 47 and forward of the threaded portion of internal passageway 44 as shown in FIG. 8A. This provides axial adjustment space or room for tightening the engagement between barrel cap 40 and mounting ring 36 of barrel insert 20 (see also FIGS. 2 and 5). Accordingly, in one embodiment barrel cap 40 has a smaller front opening 49*a* than rear opening 49*b*.

Barrel cap 40 is received in a complementary configured and dimensioned circular receptacle 37 formed adjacent to front end 31 of receiver 30 as shown. Receptacle 37 has a diameter that may be larger than forward portion 38*b* of internal cavity 38 immediately adjacent to and rearward of the receptacle. A stepped transition between cavity 38 and receptacle 37 forms a forward facing vertical surface 39 that abuts a rear facing surface 43 on rear end 45 of barrel cap 40 to limit the insertion depth of the cap into the receiver (see, e.g. FIGS. 2 and 5).

In some embodiments, as shown in FIGS. 2 and 5, the front end 41 of barrel cap 40 may be defined by and terminate at front facing surface 41 (see also FIGS. 8A-C for location of surface 41). Accordingly, when barrel insert 20 is mounted inside receiver 30, the barrel cap 40 has an axial length sufficient to receive inside passageway 44 the mounting ring 36 and an unthreaded short forward nipple or stub section 27*a* of barrel insert tubular muzzle portion 27 that extends forward from the mounting ring.

Figure 11:
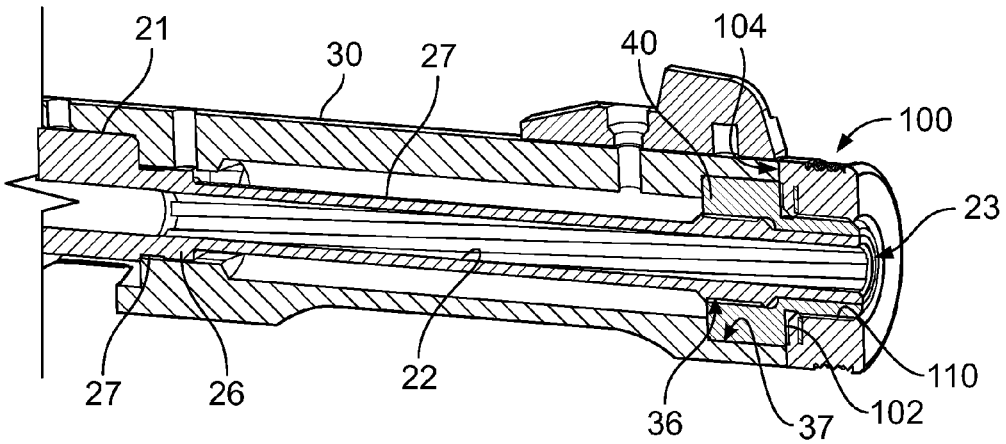
FIG. 11 is a side cross-sectional view thereof.
Figure 12:
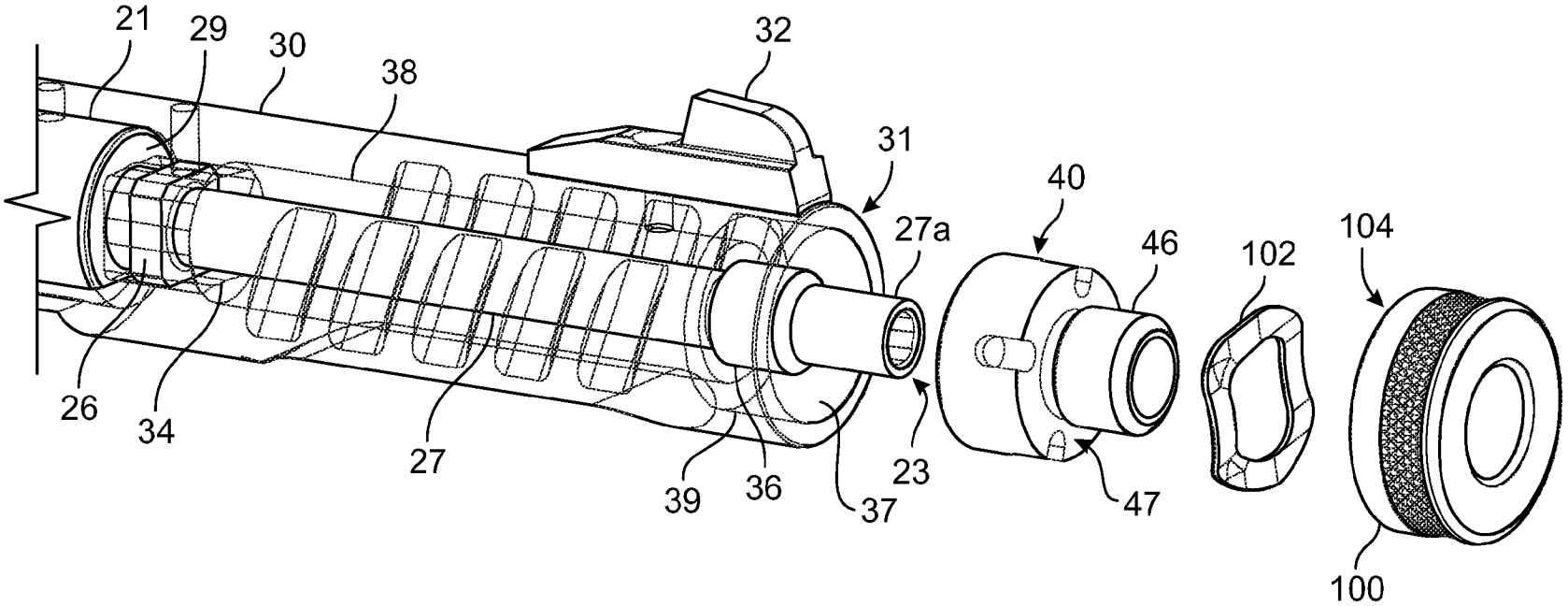
FIG. 12 is an exploded perspective view thereof.

In some alternative embodiments, without limitation, barrel cap 40 may have an externally threaded extension 46 that projects forward from the front end 41 and front facing surface 47 of the cap as shown in FIGS. 8A-C for mounting various muzzle accessories such as muzzle brakes, flash hiders, or other appurtenance (see also FIGS. 11 and 12). Advantageously, this allows a user to merely change barrel caps 40 between the embodiment depicted in FIG. 2 with the embodiment of FIG. 8 to use muzzle accessories without having to replace the barrel or receiver. Barrel cap 40 may further include one or more forwardly open tooling depressions 42 configured to be engaged by a separate tool having complementary configured tool surfaces or projections for screwing and unscrewing the cap into/from receiver 30. This allows the barrel cap to lie completely flush with the front end 31 opening of the receiver as shown in FIGS. 2 and 5 for an aesthetically pleasing appearance and to prevent damaging the cap.

Figure 10:
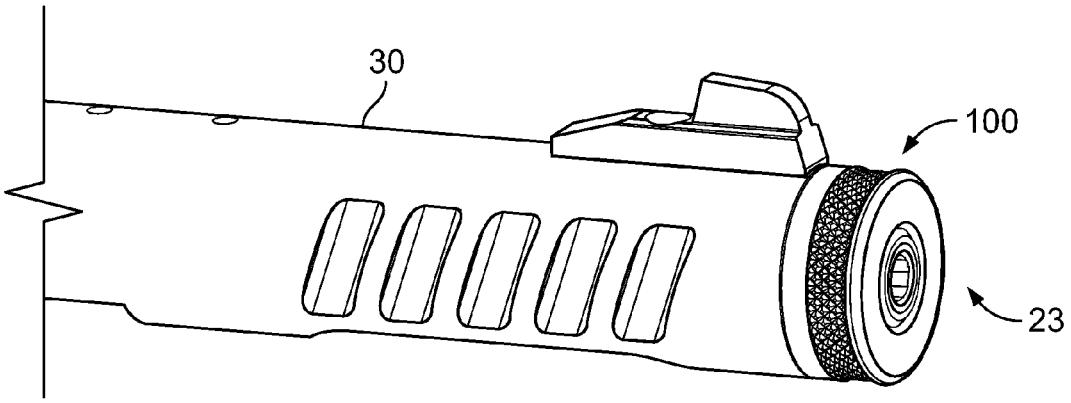
FIG. 10 is a partial side perspective view of the pistol of FIG. 1 showing a finishing cap secured to the front end of the receiver.

In one embodiment, an internally threaded finishing cap 100 is provided as shown in FIGS. 10-12 for engaging externally threaded extension 46 that projects forward from the front end 41 and front facing surface 47 of barrel cap 40 (see also FIG. 8). This finishing cap 100 may be threaded onto extension 46 of barrel cap 40 when another type muzzle accessory is not in use to protect the threading on the extension and provide a neat, finished appearance to the pistol 10. The finishing cap 100 has an axial passageway 110 that extends completely through the cap from end to end for receiving extension 46 therein. In various embodiments, the exterior of the finishing cap 100 may have a textured surface such as knurling, etc. to facilitate gripping and threading/unthreading the finishing cap from the barrel cap 40. A spring lock washer 102 is provided in some embodiments which is compressed between the rear face 104 of the finishing cap 100 and front face 47 of the barrel cap 40 as shown to help retain the finishing cap in engagement with the barrel cap extension 46 under vibrations generated by discharging the pistol 10.

As shown in FIGS. 10-12, the short forward nipple or stub section 27*a* of barrel insert tubular muzzle portion 27 that extends forward from the mounting ring 36 is axially longer than in the pistol embodiment shown in FIGS. 2 and 5 so that the barrel insert (i.e. stub section 27*a*) extends for a short axial distance forward from front end 31 of receiver 30 and concomitantly completely through barrel cap 40 and finishing cap 100 (see FIGS. 10-12). In previous embodiments of the barrel system shown in FIGS. 2-3 and 5, the entire muzzle portion 27 including stub section 27*a* are contained fully within cavity 38*b* of receiver 30 when the barrel insert 20 is mounted in the receiver. Various embodiments according to the present disclosure are not limited to either of these foregoing barrel insert arrangements.

Barrel cap 40 and finishing cap 100 may be made of any suitable metallic material, including without limitation steel, aluminum, titanium and alloys thereof for example. In one embodiment, barrel cap 40 and finishing cap 100 are made of AISI 1144 free-machining steel.

An exemplary method for assembling the interchangeable barrel system of pistol 10 according to the present disclosure will now be described.

Referring to FIG. 4, barrel insert 20, receiver 30, and barrel cap 40 are provided as already described herein. First, barrel insert 20 is slidably inserted into receiver 30 through rear end 33 and into rear portion 38*a* of cavity 38. The barrel insert 20 is configured and dimensioned in some embodiments so that the entire insert may be fully inserted into cavity 38 of the receiver 30 including enlarged rear portion 21 of the insert. The barrel insert 20 is axially slid forward until anti-rotation protrusion 26 is fully seated in a relatively forward-most position in socket 34 (see FIGS. 1-2 and 5). It should be noted that in some embodiments, socket 34 has a longer axial length than protrusion 26 so that the protrusion extends only partially into the socket (see, e.g. FIGS. 3 and 12). Mounting ring 36 is positioned proximate to front end 31 of receiver 30. At this juncture, the barrel insert 20 is still somewhat loosely fitted in the receiver. In some embodiments, forward portion 38*b* of cavity 38 may be diametrically larger than tubular muzzle portion 27 of barrel insert 20 so that an annular gap or space is formed therebetween, as shown. In one representative example, for illustration without limitation, portion 38*b* of cavity 38 may have a diameter of about 0.580 inches and muzzle portion 27 of barrel insert 20 may have an outside diameter of about 0.330 inches producing a gap of 0.250 inches (see FIG. 5). This provides space for accommodating larger diameter tubular muzzle portions 27 of other alternative barrel inserts 20 that can be interchanged with receiver 30 which are chambered for larger size cartridges and have larger diameter bores 22 to allow passage of the correspondingly larger diameter bullets or slugs. The provision of this annular space or gap is possible because barrel insert 20 is structurally self-supporting, and therefore does not rely on support from the receiver or other pistol component to withstand the discharge forces and pressure from firing the pistol as combustion gases flow through the bore 22.

Figure 9:
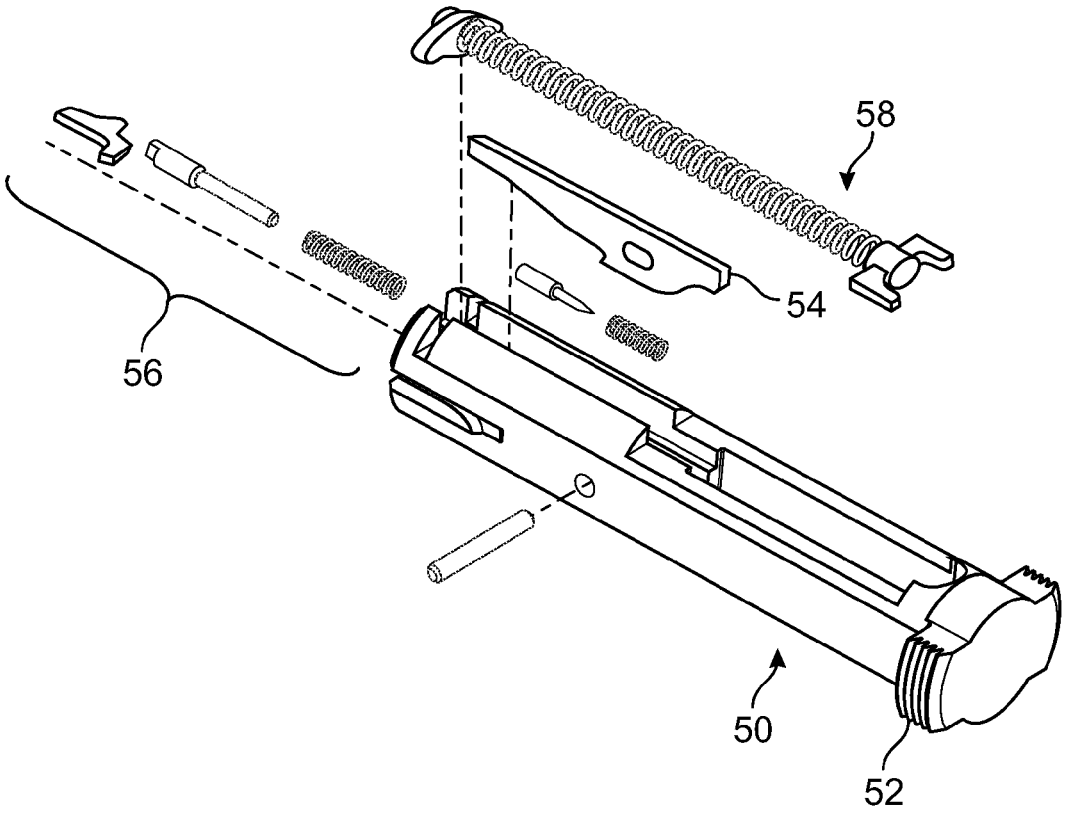
FIG. 9 is an exploded perspective view of the bolt assembly and associated components of the pistol of FIG. 1.

Next, the barrel insert 20 is releasably locked into the receiver 30. Barrel nut or cap 40 is axially inserted through front end 31 of receiver 30 until the internal threads near rear end 43 engage the external threads on mounting ring 36 of the barrel insert 20 (see also FIGS. 5-8). The barrel cap 40 is then rotated using a tool or other means to fully screw the cap onto the barrel insert 20. Once the rear end of cap 40 engages the forwarding facing surface 39 on receiver 30, continuing rotation of the cap draws the barrel insert 20 axial forward with respect to the receiver to tighten engagement between the forward facing surface 29 on enlarged rear chamber block portion 21 of the barrel insert and rearward facing surface 35 in cavity 38*a* of the receiver adjacent anti-rotation protrusion 36 and socket 34. The barrel insert 20 is now rigidly, but removably locked in position inside the receiver 30 as shown in FIGS. 2-3 and 5. Bolt 50 with related mounted appurtenances as shown in FIG. 9 may next be slidably inserted and installed in pistol 10 through the open rear end 33 of the receiver 30 to complete the assembly of the pistol (see FIG. 1).

The foregoing process may reversed to remove the barrel insert 20 from receiver 30.

In a variation of the foregoing method for assembling the interchangeable barrel system, the same assembly process steps described above are performed. In this embodiment, however, a barrel cap 40 having a forward projecting externally threaded extension 46 (see FIGS. 8A-C) and a finishing cap 100 as shown in FIGS. 10-12 are alternatively used. After the barrel insert 20 is releasably mounted and secured to the receiver 30 by tightening the engagement between the barrel cap 40 and barrel insert in the manner described above, the finishing cap is then threaded onto extension 46 of the barrel cap 40 (see FIGS. 10-12). If the optional spring lock washer 102 is used, the washer is first axially inserted over the threaded extension 46 before threading or screwing the finishing cap 100 onto the barrel cap which compresses the lock washer between the barrel cap 40 and finishing cap to help retain the finishing cap in place.

In some embodiments, without limitation, receiver 30 may be made of a malleable and relatively light-weight metal such as for example without limitation aluminum, titanium, and alloys thereof to reduce the weight of the pistol 10. In one embodiment, receiver 30 may be made of 6061-T6 aluminum which in some embodiments may be anodized. The receiver 30 may also be made of suitable reinforced (e.g. nylon or glass) or unreinforced polymers in other possible embodiments contemplated which incorporate appropriate metal inserts for mechanical strength and wear resistance where required as is well known in the art of semi-automatic pistols. The receiver 30 may be provided with various aesthetic surface finishes, treatments (e.g. anodized colorized aluminum), and colors. Advantageously, the use of a material such aluminum or polymers that lend themselves to aesthetic variation thereby permits numerous combinations of colors and/or ornamental features (see, e.g. FIG. 1) to be fabricated for receiver 30 providing a user with extensive customization options while retaining the same type and caliber of barrel insert 20 that may be interchanged with multiple receivers.

Barrel insert 20 may be made of a metal with suitable toughness and durability to withstand the combustion pressures and temperatures generated when firing the pistol. In some embodiments, without limitation, barrel insert 20 may be made of a suitable steel and alloys thereof. In one embodiment, for example without limitation, barrel insert 20 is fabricated from 410 stainless steel. Barrel insert 20 may formed as a single unitary and monolithic structure from a single piece of metal stock which is machined and otherwise formed to produce the various appurtenances of the barrel system described herein.

Receiver 30 according to one embodiment of the present disclosure therefore has a weight and density less than the weight and density of barrel insert 20 to reduce the combined total weight of barrel-receiver assembly. Accordingly, barrel insert 20 is made of a metal having a first density and the receiver 30 is made of metal having a second density, the first density being different than the second density. Preferably, the second density is less than the first density in an embodiment. A typical representative range of densities for steel or steel alloy which may be used in some embodiments for barrel insert 20 is about 7.5-8.1 grams/cubic centimeter, without limitation, depending on the type of steel used and any alloying element content. A typical range for aluminum or aluminum alloy would be about 2.7-2.8 grams/cubic centimeter without limitation. A typical range for titanium or titanium alloy would be about 4.4-4.6 grams/cubic centimeter without limitation. Advantageously, it will be apparent that substituting lower density and concomitantly lighter weight aluminum or titanium for steel to make the outer receiver 30 will result in a reduction in weight for pistol 10.

Barrel insert 20 is self-supporting and self-contained when not in the receiver 30 being structured to withstand the combustion forces and pressures without support from the receiver 30 or other secondary outer sleeve materials in contrast to constructions having a thin steel or other metal barrel liners. In one embodiment, barrel insert 20 is a single unitary structure formed from a monolithic workpiece of metal wherein the enlarged rear chamber portion 21 and forward mounting ring 36 are integral components of the unitary structure. In embodiments where insert 20 is made of steel, this advantageously allows the angled cartridge feed ramp 24 and rear facing breech face 25*a* at the rear end of chamber 28 which experience high wear to formed of steel as opposed to less durable materials such as aluminum or others (see FIGS. 7A-D). This arrangement is not typically possible if only a thin steel barrel liner inserted into a softer outer sleeve material such as aluminum were employed in lieu of a steel full barrel insert 20 disclosed herein.

Another advantage of an embodiment of an interchangeable barrel system according to the present disclosure described herein is that a user may retain the same receiver 30, and swap one or more barrel inserts 20 of different calibers to allow various kinds of ammunition to be fired from the same basic pistol platform. In some embodiments, for example, one barrel insert 20 configured and chambered for less expensive 0.22 caliber cartridges may be used for target practice which may then be swapped out for larger 0.45 caliber cartridges for shooting competition or other purposes, all using the same receiver 30. According, cavity 38 of receiver 30 is preferably configured and dimensioned to receive therein barrel inserts 20 chambered for several different size cartridges in some embodiments. The present interchangeable pistol barrel system therefore advantageously provides an economical pistol platform that reduces ownership costs for a user who can purchase a single pistol grip frame 12 and receiver 30 combination, but multiple barrel inserts 20 of different types and/or ammunition calibers.

Therefore, in another aspect according to the present disclosure, a pistol kit with interchangeable barrel system is provided that includes a grip frame 12, a receiver 30 mounted thereto, at least two barrel inserts 20, and a locking member such as barrel nut or cap 40 as all previously described herein. In one embodiment, the barrel inserts in the kit are comprised of a first barrel insert 20 configured for firing a first caliber cartridge (for example, without limitation a 0.22 caliber cartridge) and a second barrel insert configured for firing a second caliber cartridge (for example, without limitation a 0.45 caliber cartridge) that is different from the first caliber cartridge. In one embodiment, the barrel cap 40 includes a forward externally threaded extension 46 and the kit further includes a finishing cap 100 configured for mounting on the extension of the barrel cap 40.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An interchangeable barrel system for a pistol comprising:

an elongated barrel insert including a rear portion defining a chamber configured for holding a cartridge, and a forward muzzle portion having a bore defining a longitudinal axis and bullet pathway;

an elongated receiver fixedly mounted to a grip frame, the receiver remaining stationary during firing of the pistol, the receiver defining an internal cavity configured for axial insertion of the forward muzzle portion of the barrel insert into the receiver;

an anti-rotation device configured for preventing rotation of the barrel insert with respect to the receiver;

a locking member configured for releasably engaging the barrel insert to secure the barrel insert to the receiver, wherein locking member includes a forwardly protruding threaded extension for attaching an accessory; and a finishing cap configured for mounting on the threaded extension and a spring lock washer disposed between the finishing cap and locking member;

wherein the barrel insert includes a threaded locking ring disposed on the forward muzzle portion of the barrel insert that is configured to engage a complementary configured internally-threaded portion of the locking member to releasably secure the barrel insert in the receiver.

2. The barrel system of claim 1, wherein the anti-rotation device comprises an anti-rotation protrusion formed on the barrel insert and a complementary configured socket formed in the cavity of the receiver, the protrusion being axially insertable into the socket.

3. The barrel system of claim 2, wherein the anti-rotation protrusion is rectilinear shaped and the socket has a corresponding rectilinear configuration.

4. The barrel system of claim 2, wherein the locking member comprises a barrel cap that threadably engages the barrel insert to releasably secure the barrel insert, to the receiver.

5. The barrel system of claim 1, wherein the receiver is made of a metal having a first density and the barrel insert is made of a metal having a second density greater than the first density.

6. The barrel system of claim 5, wherein the barrel insert is comprised of steel and the receiver is comprised of aluminum or titanium.

7. The barrel system of claim 1, wherein when the barrel insert is mounted in the cavity of the receiver, an annular gap is formed between the forward muzzle portion of the barrel insert and the receiver.

8. The barrel system of claim 1, wherein the locking member is a disc-shaped barrel cap being sized for at least partial insertion through an open front end of the receiver into the cavity.

9. An interchangeable barrel system for a pistol comprising:

an elongated barrel insert including a rear chamber block defining a chamber configured for holding a cartridge, a front muzzle end, and a forward muzzle portion extending between the muzzle end and the chamber block, the muzzle portion having a bore defining a longitudinal axis and a bullet pathway;

an elongated receiver fixedly mounted to a grip frame, the receiver remaining stationary during firing of the pistol, the receiver defining an internal cavity aligned with the longitudinal axis and extending from a rear end to a forward end of the receiver, the muzzle portion of the barrel insert being insertable into and substantially disposed in the cavity;

an anti-rotation device configured for preventing rotation of the barrel insert with respect to the receiver; and a locking member threadably engaging the barrel insert and securing the barrel insert in the receiver;

wherein the locking member is a barrel cap that threadably engages the forward muzzle portion of the barrel insert through an open front end of the receiver, and rotating the barrel cap axially draws the barrel insert forward; and wherein rotating the barrel cap tightens engagement between a forward facing surface of the barrel insert and rear facing surface of the receiver.

10. The barrel system of claim 9, wherein the front muzzle end of the barrel insert is insertable through a rear opening of the receiver into the internal cavity.

11. The barrel system of claim 9, wherein the anti-rotation device comprises a rectilinear shaped protrusion formed on the barrel insert and a complementary configured socket formed in the cavity of the receiver, the protrusion being axially insertable into the socket, wherein when the protrusion is seated in the socket, rotation of the barrel insert is prevented.

12. The barrel system of claim 11, wherein the barrel insert includes a threaded locking ring disposed on the forward muzzle portion of the barrel insert that is configured to engage a complementary configured internally-threaded portion of the locking member to releasably secure the barrel insert in the receiver.

13. A method for assembling a barrel system for a pistol, the method comprising:

providing an elongated barrel insert including a rear portion defining a chamber configured for holding a cartridge, a front muzzle end, and a forward muzzle portion having a bore defining a longitudinal axis and bullet pathway;

axially inserting the barrel insert into a receiver;

axially engaging an anti-rotation protrusion on the barrel insert with a complementary configured socket in the receiver, the protrusion preventing relative rotation between the barrel insert and the receiver; and locking the barrel insert into the receiver;

wherein the locking step includes threadably engaging as barrel cap with the forward muzzle portion of the barrel insert through an open front end of the receiver, and axially drawing the barrel insert forward by rotating the barrel cap;

wherein rotating the barrel cap tightens engagement between a forward facing surface of the barrel insert and rear facing surface of the receiver.

14. The method of claim 13, wherein the inserting step is performed by axially inserting the front muzzle end of the barrel insert through a rear opening of the receiver into an internal cavity disposed inside the receiver.

15. A method for assembling a barrel system for a pistol, the method comprising:

providing an barrel insert including a rear portion defining a chamber configured for holding a cartridge, a front muzzle end, and a forward muzzle portion having a bore defining a longitudinal axis and bullet pathsway;

axially inserting the barrel insert into a receiver;

axially engaging an anti-rotation protrusion on the barrel insert with a complementary configured socket in the receiver, the protrusion preventing relative rotation between the barrel insert and the receiver;

locking the barrel insert into the receiver, wherein the locking step includes threadably engaging a barrel cap with the forward muzzle portion of the barrel insert through an open front end of the receiver, and axially drawing the barrel insert forward by rotating the barrel cap; and threadably engaging a finishing cap with the barrel cap.

* * * * *